US006550207B1

(12) United States Patent
Pontarolo

(10) Patent No.: US 6,550,207 B1
(45) Date of Patent: Apr. 22, 2003

(54) MODULAR ELEMENT FOR CRAWL SPACES AND FLOOR STRUCTURES

(76) Inventor: Valerio Pontarolo, Via S. Caterina, 4/A, 33073 Cordovado (IT)

( * ) Notice: Subject to any disclaimer, the term of this patent is extended or adjusted under 35 U.S.C. 154(b) by 0 days.

(21) Appl. No.: 09/914,609

(22) PCT Filed: Jul. 5, 1999

(86) PCT No.: PCT/IB99/01237

§ 371 (c)(1),
(2), (4) Date: Aug. 31, 2001

(87) PCT Pub. No.: WO00/52279

PCT Pub. Date: Sep. 8, 2000

(30) Foreign Application Priority Data

Mar. 3, 1999 (IT) ..... UD99A0049

(51) Int. Cl.[7] ..... E04C 3/30

(52) U.S. Cl. ..... 52/577; 52/577; 52/505; 52/437; 52/438

(58) Field of Search ..... 52/577, 505, 437, 52/438

(56) References Cited

U.S. PATENT DOCUMENTS 906,195 A * 12/1908 Burker et al. ..... 52/220.2
1,087,644 A * 2/1914 Crane ..... 52/220.2
2,101,019 A 12/1937 Bowes
2,792,164 A * 5/1957 Cauffiel ..... 52/220.2
4,468,911 A 9/1984 Daga
5,263,289 A * 11/1993 Boyd ..... 52/220.2
5,469,674 A * 11/1995 Morello ..... 52/220.2

FOREIGN PATENT DOCUMENTS

DE 445275 7/1927
EP 0803618 10/1997

* cited by examiner

*Primary Examiner*—Carl D. Friedman
*Assistant Examiner*—Nahid Amiri
(74) *Attorney, Agent, or Firm*—Antonelli, Terry, Stout & Kraus LLP

(57) ABSTRACT

Modular element for floor structures or crawl spaces used in self-supporting structures, the modular element including an upper surface (11) and supporting legs (13), the modular element defining, either alone or in combination with one or more identical modular elements (10) associated therewith, a seating (17) to position and anchor a structural reinforcement element, the seating (17) being sized in such a way as to accommodate a reinforcement element suitable to fulfil a static bearing function, the structural reinforcement elements, once installed and incorporated into the cast concrete, allowing to form a self-supporting reinforced structure.

17 Claims, 7 Drawing Sheets

MODULAR ELEMENT FOR CRAWL SPACES AND FLOOR STRUCTURES

This invention concerns a connection element for connecting modular elements for crawl spaces and floor structures as set forth in the main claim.

The connection element according to the invention is able to connect modular elements applied in the building trade, for both civil and industrial buildings and restructuring, so as to achieve self-supporting constructions to be cast on site, suitable to function as a crawl space to insulate the floors from the underlying ground, and also as an intermediate floor structure between storeys, and also to achieve roofing, floating floors, ventilated roofs, upset roofs or other similar structures.

BACKGROUND OF THE INVENTION

The state of the art includes structures, called crawl spaces, used to make the bases for floors and suitable to create an insulating interspace between the floor and the underlying ground so as to prevent humidity and/or concentrations of gas from rising inside the buildings.

These structures define interspaces suitable to allow the air to circulate. They are made of modular elements consisting of expendable formworks equipped with legs and able to be jointed together or associated in some other manner.

These formworks are easy and quick to install, and moreover the concrete can be cast immediately after they have been installed.

The formworks, associated together, define on the upper part a substantially continuous surface which acts as a base for the cast concrete, and a plurality of vertical ribs and fissures which form pillars, uniformly distributed and able to increase the load capacity of the crawl space.

In a large number of applications, the covering layer of concrete is reinforced with metal rods, consisting of an electronically welded mesh and/or iron round pieces, in order to consolidate the floor.

The metal rod reinforcement is placed on the plane defined by the formworks and then incorporated into the covering layer of concrete.

When round pieces are used, as it is not possible to anchor these elements to the formworks, the round pieces are attached to each other with metallic wire, by means of welding or other operations in order to prevent them from moving from their original collocation during the laying of the concrete.

All this causes problems which limit the complete and rational use of the crawl spaces with expendable formworks.

Another disadvantage is that structures such as are known in the state of the art made with such formworks are not self-supporting and therefore need an adequate support on an appropriately consolidated foundation.

In the event that the underlying foundation should subside, even in part, the whole planar structure consisting of the modular elements already assembled may crack, yield or bend, with obvious dangerous consequences to the floors above.

Furthermore, since the finished floor structure is not self-supporting, the modular elements known in the state of the art cannot be used in an efficient manner to construct self-supporting floor structures.

My previous patent application EP-A-0 803 618 discloses a modular element for the support and ventilation of floors, and suitable to support a layer of reinforced concrete defining a space wherein the air circulates and which separates the underlying ground and the layer of concrete. Such modular element includes an upper face, supporting legs and, in an underlying position, a pillar element for support and reinforcement.

The connection element and the associated improved modular elements according to the present invention have been designed and embodied to overcome the shortcomings of the state of the art and to obtain further advantages.

SUMMARY OF THE INVENTION

The invention is set forth and characterised in the main claim, while the dependent claims describe other characteristics of the idea of the main embodiment.

The purpose of the invention is to provide a connection element or auxiliary element for removably connecting two modular elements which can be used in self-supporting structures suitable to be used both below the base plane of the construction, to ensure insulation between the floor and the underlying ground, and also as a floor structure between intermediate storeys, and also as a roofing element.

The fact that the structure obtained with a plurality of modular elements according to the invention is self-supporting ensures that it has a high level of stability, even when there is a partly yielding supporting surface or base ground.

The modular element allows, alone or in combination with one or more analogous modular elements associated therewith, to position and anchor the structural reinforcement elements, such as beams, joists, lattices or similar, which have a static bearing function.

Such structural reinforcement elements, once they have been installed and incorporated into the cast concrete, form a self-supporting structure, which can also have a net-like structure, one-directional or two-directional.

The structure performs both a stabilising function if positioned on yielding bases or ground, and also, especially, the function of a self-supporting structure to constitute, for example, a floor structure for intermediate storeys or a roofing for the construction.

The floor structure defined with the improved modular elements according to the invention can be either planar or inclined, vaulted, barrel-shaped, dome-shaped, or some other shape.

The improved modular element according to the invention also allows an easy and quick positioning of conduits, pipes and cables, and an easy and accurate positioning of auxiliary reinforcement elements, for example round pieces or longitudinal rods, which act as a further support and reinforcement.

Another purpose of the invention is to obtain a modular element which can be used to support or accommodate accessory elements functional to the installation, preparation and/or functioning of technological networks or service networks of the construction where it is used.

A further purpose of the invention is to considerably reduce the spaces needed for storage, and also to facilitate transport and on-site assembly operations and make them more functional.

The improved modular element according to the invention has a conformation defined by lower supporting legs and by a substantially planar upper surface.

The upper surface is defined by a convex base plane which bends downwards in such a way that it extends, at the corners, into the aforesaid legs substantially without interruption.

The structure thus obtained delimits, inside and below, a space which guarantees a suitable insulating height between the upper surface and the floor, and also a ventilation area wherein the air can circulate.

According to the invention, in a first embodiment, in correspondence with at least one side the modular element has its relative legs, located at the four corners, connected to each other by an arch which is lowered with respect to the base plane of the upper surface.

The lowered arch, when coupled with an identical lowered arch of an adjacent modular element, defines a positioning seating suitable to accommodate a reinforcement element, such as a beam, a joist or a lattice.

According to the invention, the positioning seating has a depth of at least 10 centimetres with respect to the highest point defined by the upper surface of the modular element, thus allowing a reinforcement element with static structural bearing characteristics to be positioned.

The conformation of the structural reinforcement element can be chosen as desired, for example rectangular, T-shaped, triangular or other.

By coupling a plurality of modular elements according to the invention until a substantially continuous surface is achieved which defines the floor or the floor structure element, a plurality of positioning seatings is defined for reinforcement elements.

The reinforcement elements, placed in position, can form a reinforced structure which, when incorporated into the cast concrete and after consolidation thereof, constitutes a self-supporting structure which collaborates to form the floor of the construction, whether it be a base floor or an intermediate floor.

In another embodiment of the invention, the modular element comprises a lowered hollow made along at least one median axis of its upper surface and defining the positioning seating for the reinforcement element, beam, joist or lattice.

In this case too, by coupling a plurality of modular elements according to the invention it is possible to define positioning seatings which will allow to form a reinforced mesh with a self-supporting and consolidating structural function.

According to another embodiment of the invention, the connection or auxiliary element is shaped like a bow and a cradle, equipped with means to anchor itself to the bow-shaped lateral edges of two elements of the type described above and arranged adjacent to each other, so as to define at least a positioning seating for reinforcement elements.

In this embodiment, therefore, the modular elements of the type described above do not couple directly with each other, attaching the relative lateral edges, but by means of the bow-shaped and cradle-shaped auxiliary elements, which thus perform both the function of reciprocal connection between the modular elements, and also that of positioning seating for the reinforcement elements.

Two or more connection or auxiliary elements may be arranged laterally adjacent to position two respective reinforcement elements adjacent, so as to constitute a beam of a width which is a multiple of the width of the individual reinforcement element.

According to a variant, the positioning seatings for the reinforcement elements include means or seatings to support and accommodate auxiliary round pieces or rods, the function of which is to stiffen and further reinforce the self-supporting structure consisting of the combination of modular elements.

The modular element according to the invention can assume, in a variant of the invention, a conformation without any protruding zones or discontinuities, and with all positive angles so that, in the event it is used to make floor structure elements, the element can be removed after the concrete cast has been made and consolidated.

According to one embodiment of the invention, the lower end of the legs is shaped in such a manner as to ensure that the modular element lies stably on the base surface and to allow easy and rapid connection operations to associate two or more modular elements according to the invention to each other.

According to another variant, the lower ends of the legs include means to attach the modular element to the supporting surface, such as for example, holes for screws, nails or rivets.

These attachment means can also be employed to mount possible extensions, used to raise the plane defined by the modular elements.

According to another variant, in correspondence with the upper face there is at least a hole whose inner surface defines a truncated cone, or a truncated pyramid.

According to a first variant, the smaller base of this hole is closed, and is located at the same height as the supporting base of the modular element.

According to another variant, the hole is central; according to yet another variant, the invention has two or more holes.

When the elements are stored, at least one hole makes it possible to place the elements one above the other and stack them temporarily, so as to make a stable and easily transportable stack.

During the operational step, before the concrete is poured, the independent load capacity is much higher.

It is within the spirit of the invention to provide ridges, in correspondence with the support for the beams, lattices or otherwise, the ridges being suitable to hold the metal structure detached from the surface of the modular element or in any case from its positioning seating, in order to obtain that the metal structure is completely incorporated into the concrete.

BRIEF DESCRIPTION OF THE DRAWINGS

The attached Figures are given as a non-restrictive example, and show some preferred embodiments of the invention as follows.

DETAILED DESCRIPTION OF PREFERRED EMBODIMENTS

The modular element 10 according to the invention is shown in the attached Figures in some of its preferred embodiments.

It has substantially a single structure made of plastic or some other equivalent material, advantageously of a recyclable or environmental-friendly type.

The single structure is defined by an upper face 11, convex and substantially circular in shape, including in the case shown here a centre 12, consisting of a circular, concave surface.

Figure 5:
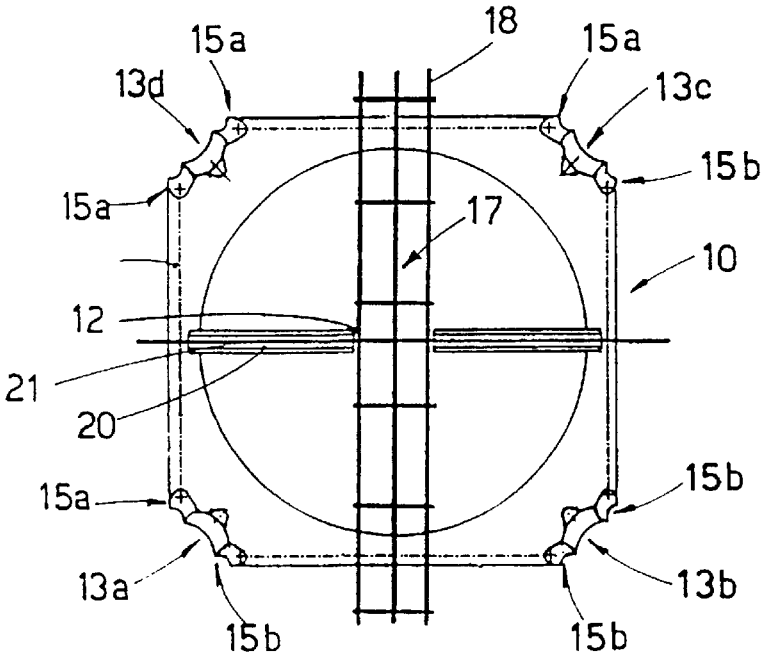
FIG. 5 is a view from above of the modular element shown in FIG. 4.

At the four corners, the upper face 11 extends downwards so as to constitute four legs 13, respectively 13*a*, 13*b*, 13*c* and 13*d* (FIG. 5).

Each leg 13 has a base 14 equipped with specific connection means 15*a* and/or 15*b*, and possibly with holes, not shown here, to possibly attach the element to the ground or to the supporting surface, by means of screws, nails or other means. These holes can also be used to position possible extensions if it should be desired to increase the height of the plane defined by the elements 10.

The connection elements 15*b* consist of an extension of the supporting base 14 and are equipped with an abutment element 16 of a substantially semi-circular shape which delimits a supporting surface for the mating elements 15*a* of the adjacent modular element 10.

The connection elements 15*a* also constitute an extension of the supporting base 14 but their supporting surface is at a height substantially corresponding with the thickness of the supporting surface of the elements 15*b*.

In this way, when several modular elements 10 according to the invention are connected together, the connection elements 15*a* are super-imposed above the connection elements 15*b*.

In this case, so as to allow every modular element 10 to couple with the four adjacent modular elements 10, the legs 13*a* and 13*c* include both the connection element 15*a* and also 15*b*, the leg 13*b* includes two connection elements 15*b*, and finally the leg 13*d* includes two elements 15*a*, as shown in FIG. 5.

Each of the legs 13 is connected to an adjacent leg 13 by means of an arch 19, defining the four sides of the modular element 10; the arches 19 also have the function of defining the zone through which air can pass, underneath the plane defined by the upper face 11.

Figure 1:
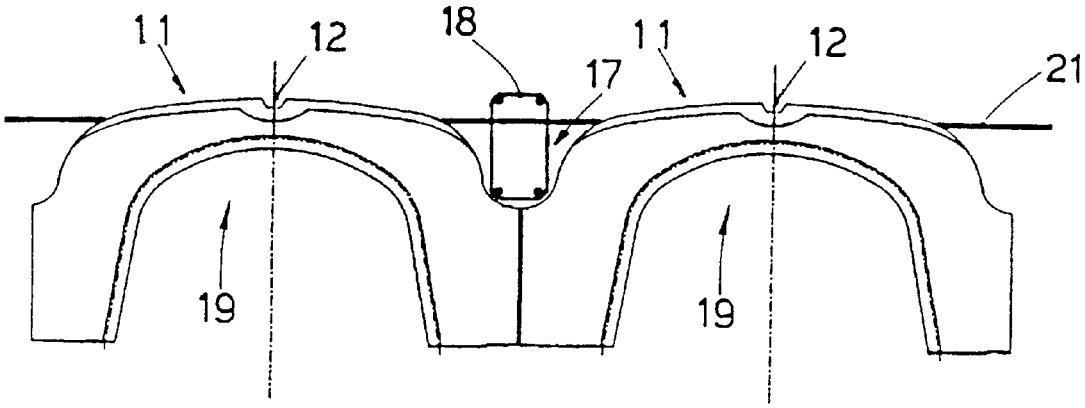
FIG. 1 is a side view of two adjacent modular elements according to the invention.

In the embodiment shown in FIGS. 1÷3, at least two arches 19 defining two opposite sides of the modular element 10 are lowered with respect to the height of the upper surface 11 so as to define, together with the lowered arch 19 of a mating adjacent modular element 10, a positioning seating 17 for a structural reinforcement element 18, in this case consisting of a rectangular beam.

The positioning seating 17 is sized, with respect to the upper level of the modular element 10, in such a way as to be able to accommodate a reinforcement element 18 suitable to perform a static bearing function, after the concrete has been cast to achieve the floor structure or crawl space.

In the preferential embodiment of the invention, the depth of the positioning seating 17 with respect to the highest level of the upper surface of the modular element 10 is at least 10 centimetres.

When the modular elements 10 are assembled, in the step when the crawl space is formed under a floor, or of a floor structure element for an intermediate storey or for a roof, a plurality of seatings 17 are defined which allow reinforcement elements 18 to be installed.

Figure 2A:
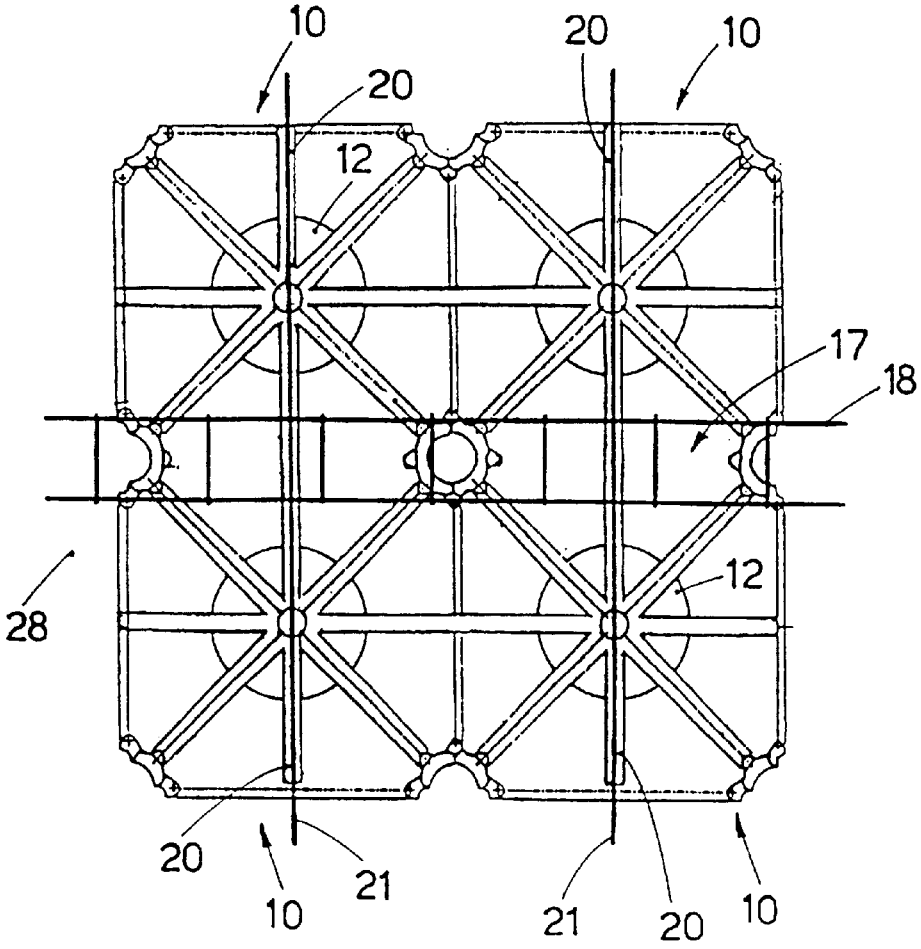
FIG. 2*a* is a view from above of four modular elements according to the invention coupled so as to form a section of self-supporting floor or floor structure element.
Figure 2B:
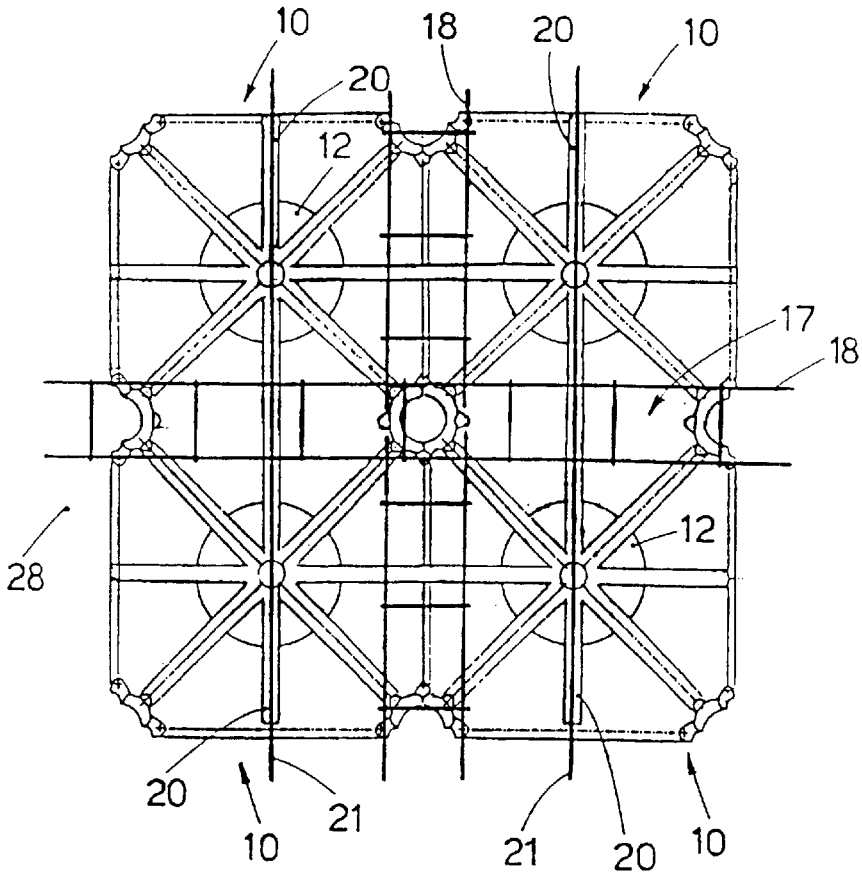
FIG. 2*b* shows a variant of FIG. 2*a* with a floor structure with crossed ribs.

The reinforcement elements 18, once incorporated into the cast concrete, constitute a reinforced mesh either one-directional (FIG. 2*a*) or two-directional with crossed ribs (FIG. 2*b*), which makes the entire structure self-supporting and hence suitable to be positioned on a partly yielding ground, and to use as a self-supporting floor structure for an intermediate storey or for a roof.

The reinforcement elements 18 may co-operate with longitudinal rods or round pieces 21 housed below the plane of the upper surface 11 in appropriate grooves 20 made along a median axis of the surface 11.

The longitudinal rods or round pieces 21 may equally be inserted inside the volume defined by the reinforcement elements 18.

Figure 3:
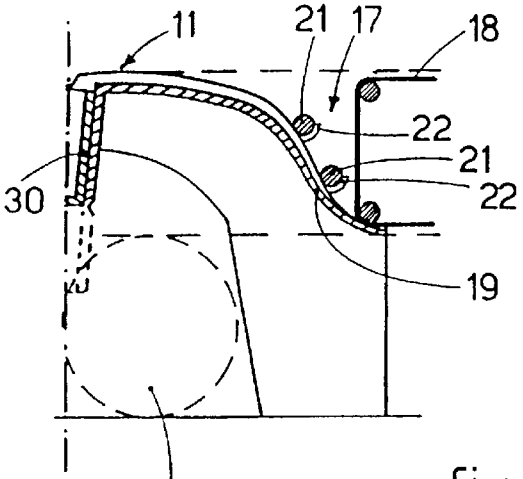
FIG. 3 shows a cross-section of one half of a modular element according to the invention in a variant of FIG. 1.

In the variant shown in FIG. 3, on the outer surface of the lowered arch 19, the modular element 10 has means 22 to support and position other longitudinal rods or round pieces 21, the function of which is to stiffen and further consolidate the self-supporting structure defined by the combination of modular elements 10.

In FIG. 3 a line of dashes shows a pipe 34 which can be located below the upper surface 11.

FIG. 3 also shows, in part, a pillar 30, the function and characteristics of which will be explained in greater detail with reference to FIG. 6.

Figure 4:
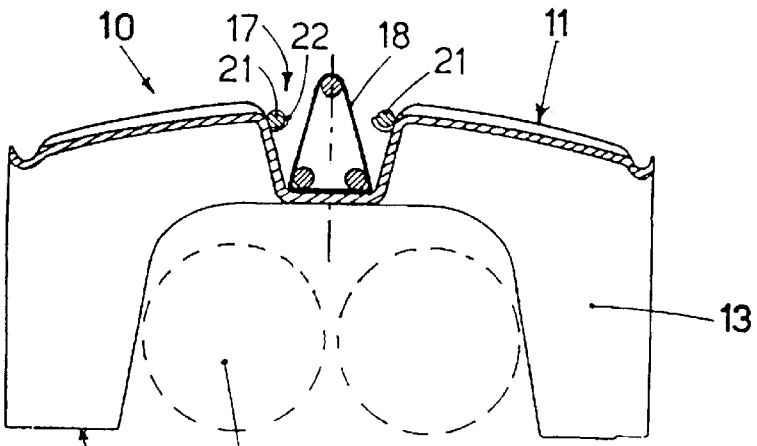
FIG. 4 is a side view of a modular element according to another embodiment of the invention.

In the variant shown in FIG. 4, along one of its median axes, the modular element 10 has a hollow defining a positioning seating 17 for a reinforcement element 18, in this case a rectangular lattice.

By coupling a plurality of modular elements 10 in the manner shown in FIG. 2, in this case too we obtain a one-directional or two-directional mesh, consisting of a plurality of reinforcement elements 18 having a static function, such as beams, joists, lattices, of any shape or section provided they are compatible with the size of the seating 17.

The reinforcement elements 18 co-operate with the rods or round pieces 21 inserted into the median grooves 20 of the upper surface 11.

In the case shown in FIG. 4, on the inner walls of the seating 17 there are means 22 to support and position auxiliary reinforcing round pieces 21.

The means 22, like the means 22 shown in FIG. 3, can be used to position and protect grooves or small conduits used to form technological networks, for example water or electricity, or service networks.

This use is particularly efficacious when the modular elements 10 are applied as floor structure elements for intermediate storeys.

Figure 6:
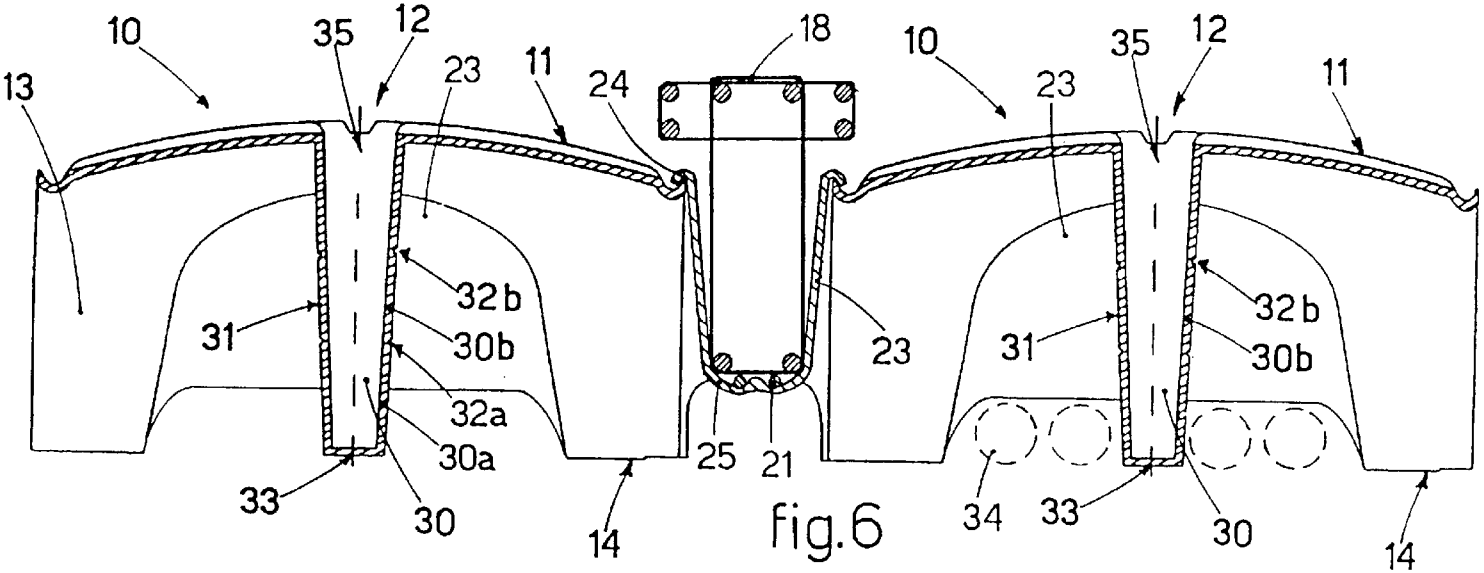
FIG. 6 shows two modular elements according to another embodiment of the invention coupled together.

The further embodiment shown in FIG. 6 provides that the modular elements 10 are not reciprocally connected by direct coupling of the respective arches 19, but by means of an auxiliary connection element 23, shaped substantially like an arch and like a cradle, located between two adjacent elements 10.

The edges 24 of the auxiliary element 23 are hook-shaped, mating with the shape of the arches 19 of the elements 10.

Figure 10:
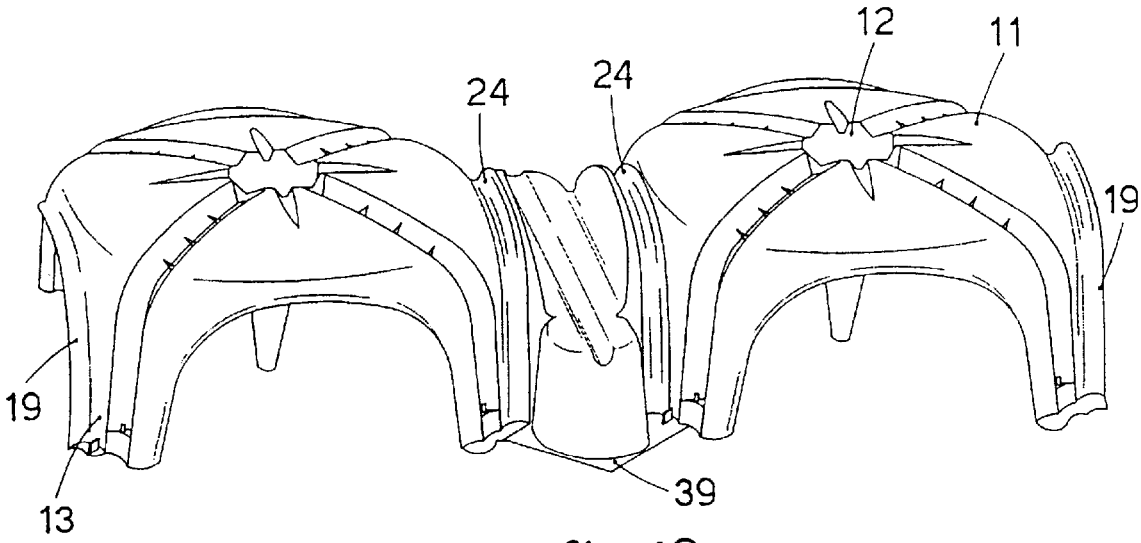
FIG. 10 shows the auxiliary element shown in FIG. 7 arranged in its working position.

The edges 24 anchor on the arches 19 of the modular elements 10 on which they are applied and follow the development thereof substantially until they are level with the supporting surface (FIG. 10).

The function of the auxiliary element 23 is to define a positioning seating 17 for a reinforcement element 18, in the case of FIG. 6, a T-beam.

In the case of FIG. 10, the seating 17 has a positioning groove which maintains the reinforcement element 18 in position once it has been inserted inside.

Figure 7:
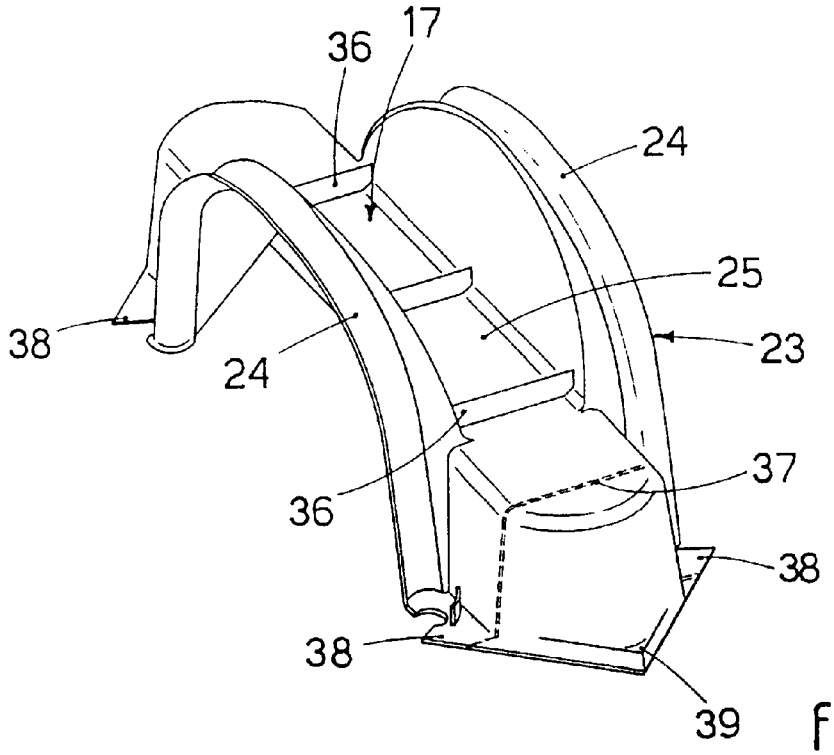
FIG. 7 is a prospective view of an auxiliary element used in the embodiment shown in FIG. 6.
Figure 8:
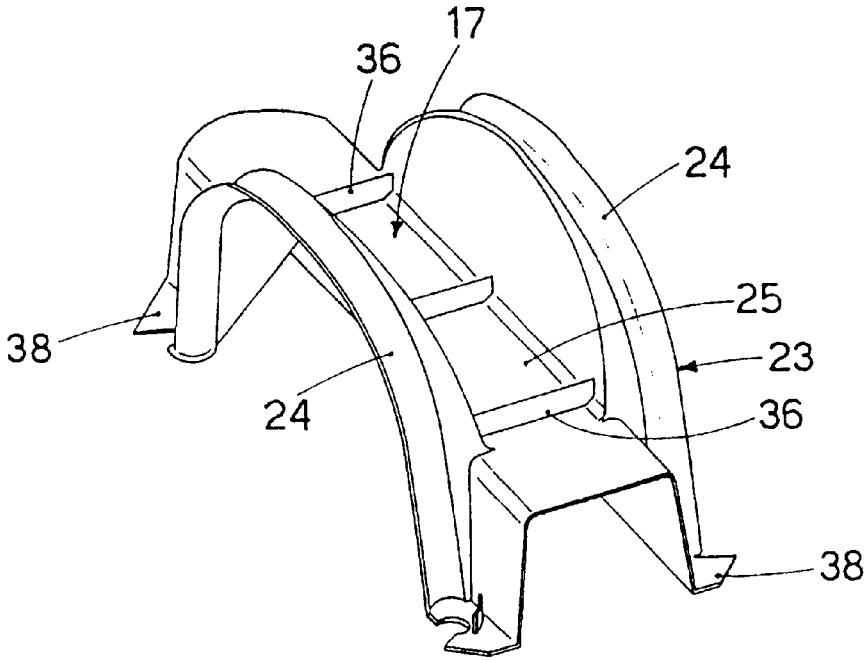
FIG. 8 shows the auxiliary element shown in FIG. 7 after one end has been removed.

As can be seen in FIG. 7, the seating 17 is defined laterally by the inner walls of the edges 19 and, in this embodiment, has supporting elements 36 on the bottom 25 which allow to keep the reinforcement elements 18 slightly raised with respect to the supporting plane so as to allow them to be completely incorporated in the concrete when it has been cast.

The supporting elements 36 can incorporate or co-operate with elements to clamp and position the reinforcement elements.

Figure 9:
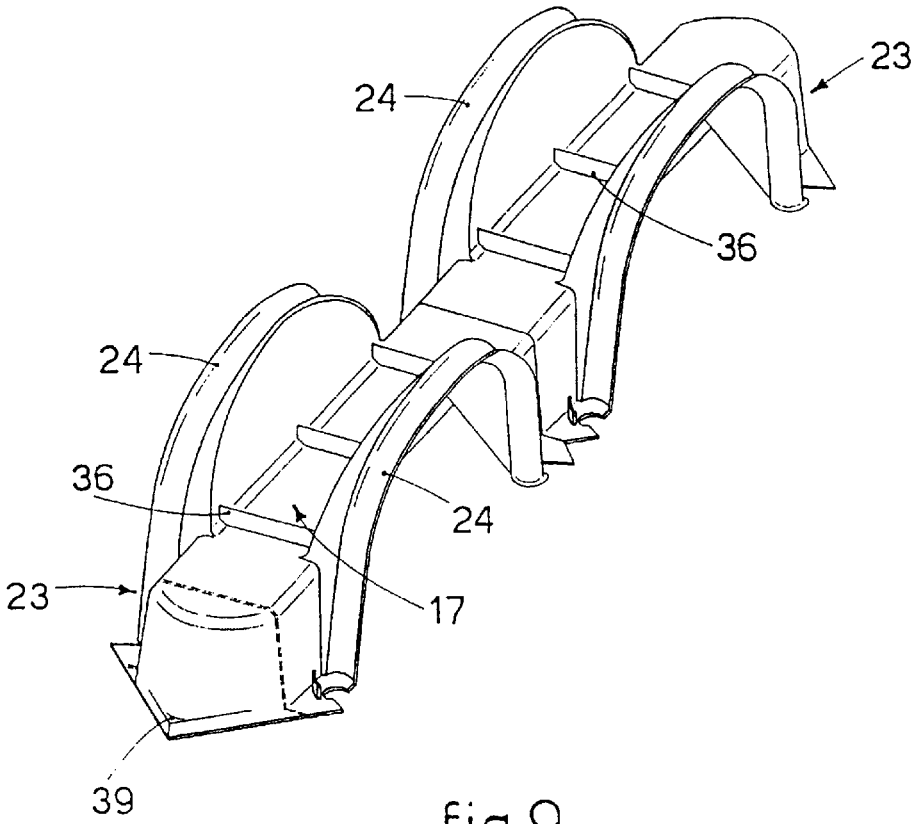
FIG. 9 shows two auxiliary elements coupled.

At least one of the points 39 of the auxiliary element 26, in this case, has a pre-breaking cut 37 which allows to easily remove the last segment of the point in order to prepare the auxiliary element 23 for in-line lock-on coupling with another auxiliary element 23 of the same type, as shown in FIG. 9.

The auxiliary elements 23 may include their own base means 38 to anchor them to the supporting surface.

Figure 11:
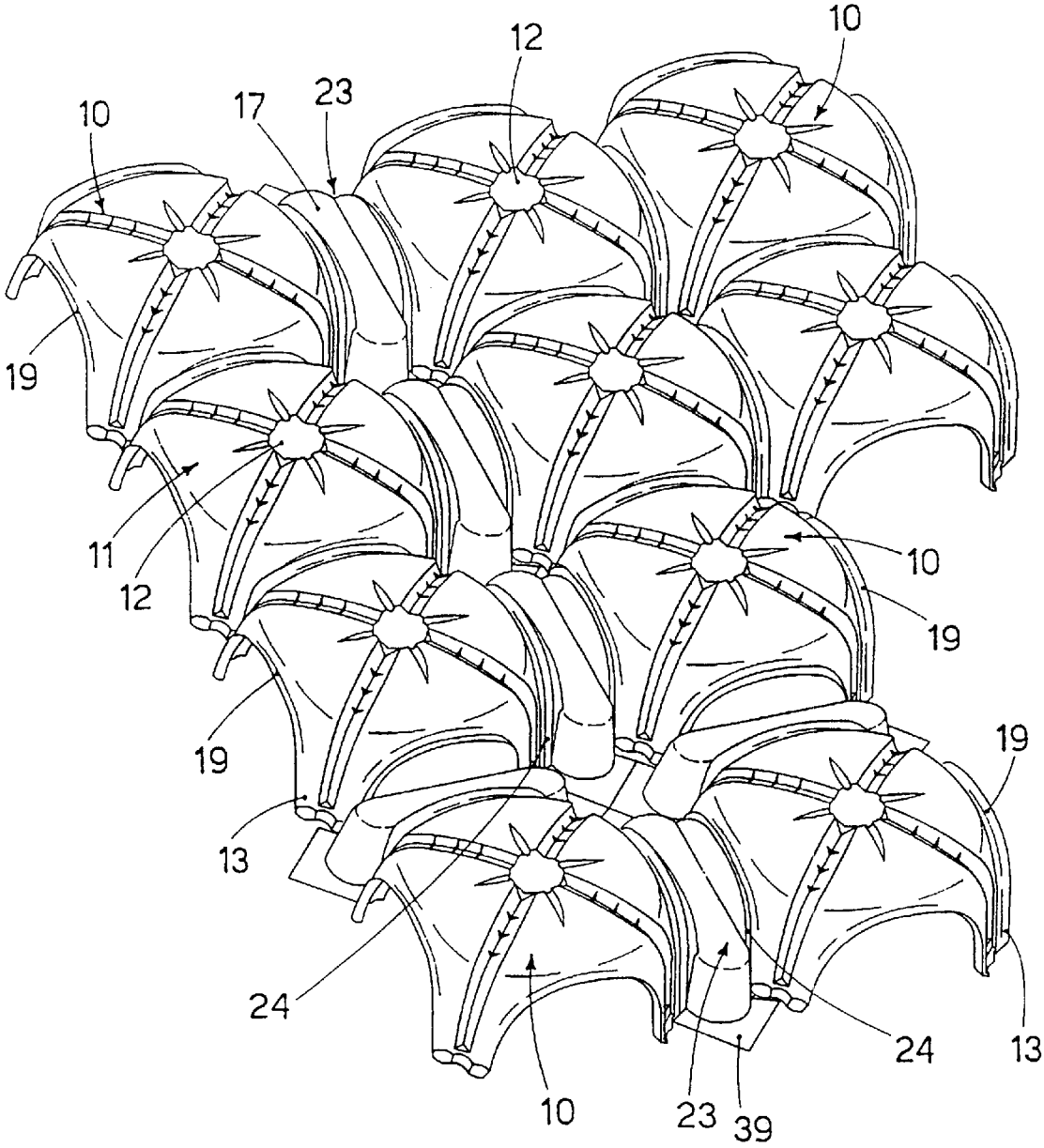
FIG. 11 is a prospective view of a plurality of modular elements coupled to constitute a section of floor structure or crawl space.

As in the cases shown previously, when a plurality of elements 10 is assembled to form a substantially plane structure with the desired dimension, the auxiliary elements 23 allow to define a plurality of seatings 17 which constitute a reinforced mesh with a structural function, as shown in FIG. 11 which refers to a one-directional embodiment.

Figure 12:
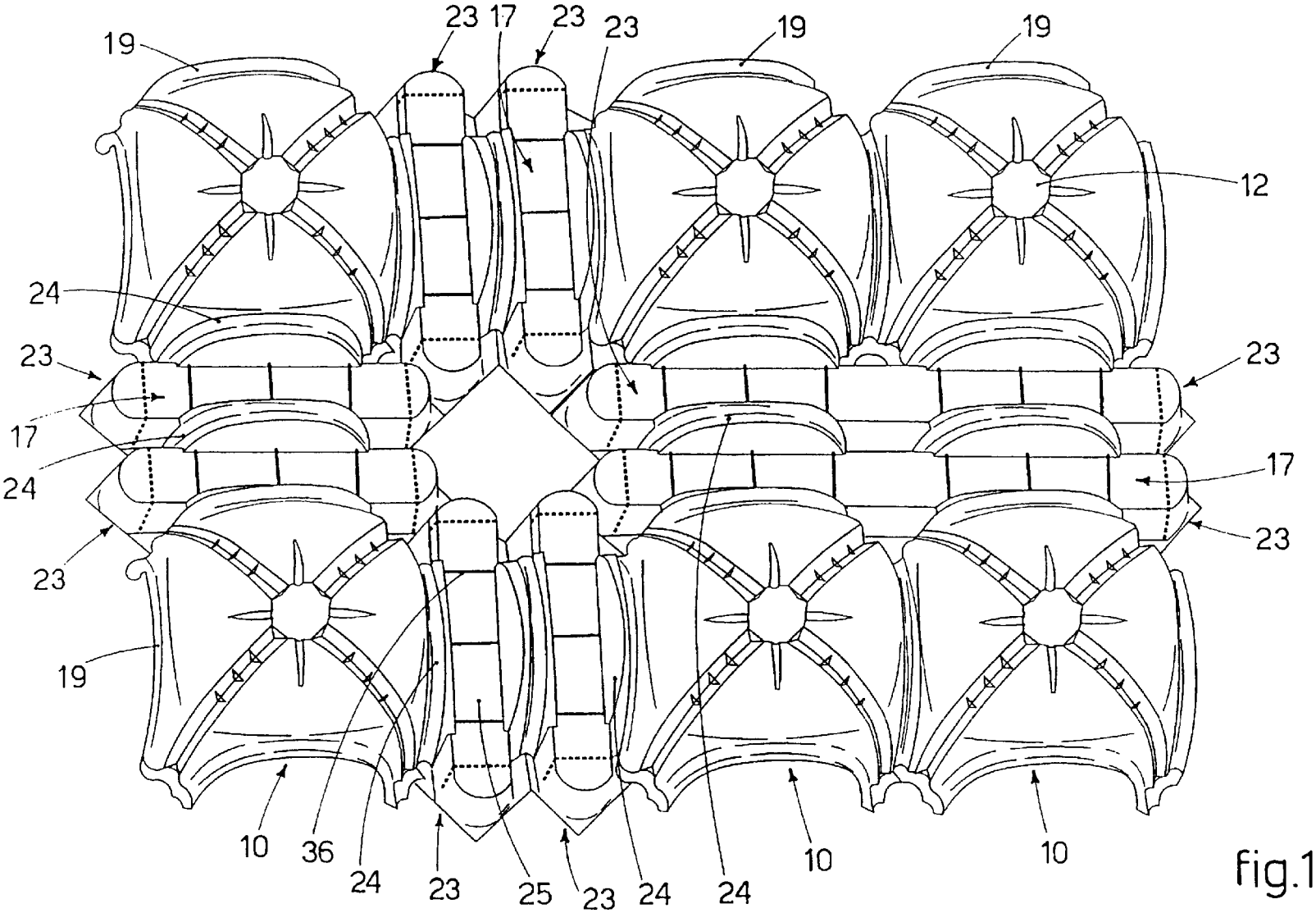
FIG. 12 shows a variant of FIG. 11 applied to achieve a two-directional mesh and wherein two adjacent auxiliary elements are used to accommodate two reinforcement elements.

On the contrary, the embodiment shown in FIG. 12 refers to a two-directional structure, wherein the auxiliary elements 23 are arranged in two directions orthogonal to each other in an intermediate position between adjacent modular elements 10.

The point 39 of each auxiliary element 23 is shaped in a right angle so as to be able to couple with the points 39 of the other contiguous auxiliary elements 23.

In this case, between two elements 10 there are two auxiliary elements 23 arranged adjacent with the respective co-operating edges 24, so that two adjacent reinforcement elements 18 can be inserted into the respective seatings 17.

It is possible however, within the limits of the design plans and according to the overloads and gaps required, to provide even three or more auxiliary elements 23 arranged adjacent between two elements 10, each of these co-operating with a respective reinforcement element 18.

In the case shown in FIG. 6, only for the modular element 10 on the right, in the underlying part of the upper surface 11, there are means to support and position conduits or grooves for technological networks or service networks. These means can consist of guide holes inside which the conduits or grooves are inserted.

Again in the embodiment shown in FIG. 6, on the upper face 11 in correspondence with the center 12, instead of the concave circular surface, there is a hole 35 with a circular section defining, in co-operation with a wall 31, a hollow pillar element 30 to act as a support and reinforcement, in this case shaped like a truncated cone, closed at the lower part by a base 33.

Along the pillar element 30 there are one or more furrows 32*a*, 32*b* on the wall 31 which allow the lower section 30*a* alone, or also an intermediate section 32*b*, to be easily separated from the pillar element 30.

The lower 30*a* or intermediate 30*b* section, once detached, are inserted inside the hole 35 and act as a plug, thus allowing to prevent the pillar element from filling up.

What is claimed is:

1. A connection element for removably connecting modular elements which are able to define a floor structure for intermediate stories, roofing, floating floors, ventilated roofs or upset roofs or a craw space used in self-supporting structures for insulating the floors from the underlying ground, wherein each one of said modular elements comprises an upper surface and supporting legs defining at least a lateral arch, said connection element being characterized in that it is shaped to define an arch element and a cradle element with lateral edges able to be connected to the corresponding lateral arches of the modular elements to be connected, to achieve a substantially continuous structure, said arch element being shaped so as to define downwardly a continuity of opening together with said modular elements connected thereto, for lodging conduits, pipes or similar elements, and said cradle element defining a seating for lodging at least one structural reinforcement element, such as a beam, a joist or a lattice able to fulfill a static bearing function.

2. A connection element as in claim 1, characterized in that each one of said lateral edges is able to be coupled with a corresponding lateral edge of an analogous connection element to define two adjacent positioning seatings for two reinforcement elements.

3. A connection element as in claim 1, characterized in that it further comprises on the bottom of the seating, supporting elements suitable to hold the relative reinforcement element in a raised position and to allow it to be incorporated substantially completely into a cast concrete.

4. A connection element as in claim 1, characterized in that it further comprises a point equipped with a pre-breaking cut such as to allow the removal of a last section in the event of in-line coupling of two or more connection elements therebetween.

5. A combination of at least one modular element able to define a floor structure for intermediate stories, roofing, floating floors, ventilated roofs or upset roofs or a craw space used in self-supporting structures for insulating the floors from the underlying ground, and a connection element, wherein said modular element comprises an upper surface and supporting legs defining at least a lateral arch, characterized in that said connection element is shaped to define an arch element and a cradle element with lateral edges able to be connected to the corresponding lateral arches of the modular element to be connected, to achieve a substantially continuous structure, said cradle element defining a first seating for lodging at least one structural reinforcement element, such as a beam, a joist or a lattice able to fulfill a static bearing function, whereby said structural reinforcement element, once installed and incorporated into a cast concrete, is able to perform the formation of a self-supporting reinforced structure.

6. A combination as in claim 5, characterized in that said lateral arch of said modular element defines, alone or in combination with a corresponding lateral arch element of an analogous modular element, a second seating to lodge upwardly a further structural reinforcement element.

7. A combination as in claim 6, characterized in that said second seating defined by two modular elements associated therebetween has a depth, with respect to the highest level of the upper surfaces thereof, of at least 10 centimeters.

8. A combination as in claim 5, characterized in that said modular element has, along one of its median axes, a hollow defining a third seating to position and anchor at least an additional reinforcement element.

9. A combination as in claim 5, characterized in that in co-operation with the seatings to position and anchor reinforcement elements there are means or seatings to support and position auxiliary round pieces or rods.

10. A combination as in claim 5, characterized in that, said modular element, below the upper surface thereof, includes means to support and position conduits or grooves for technological or service networks.

11. A combination as in claim 5, characterized in that, said modular element, in an underlying position of the upper surface includes at least a supporting and reinforcing pillar element.

12. A combination as in claim 11, characterized in that the supporting and reinforcing pillar element is open at the upper part and has at least one preferential pre-breaking zone to define at least a sub-element which can be detached from the modular element and inserted as a lock-in plug to close the element.

13. A connection element for removably connecting modular elements which are able to define a floor structure for intermediate stories, roofing, floating floors, ventilated roofs or upset roofs or a craw space used in self-supporting structures for insulating the floors from the underlying ground, wherein each one of said modular elements comprises an upper surface and supporting legs defining at least a lateral arch, said connection element being characterized in that it is shaped to define an arch element and a cradle element with lateral edges able to be connected to the corresponding lateral arches of the modular elements to be connected, to achieve a substantially continuous structure, each one of said lateral edges being able to be coupled with a corresponding lateral edge of an analogous connection element to define two adjacent positioning seatings for two reinforcement elements, and said cradle element defining a seating for lodging at least one structural reinforcement element, such as a beam, a joist or a lattice able to fulfill a static bearing function.

14. A connection element as in claim 13, characterized in that it further comprises on the bottom of the seating, supporting elements suitable to hold the relative reinforcement element in a raised position and to allow it to be incorporated substantially completely into a cast concrete.

15. A connection element as in claim 13, characterized in that it further comprises a point equipped with a pre-breaking cut such as to allow the removal of a last section in the event of inline coupling of two or more connection elements therebetween.

16. A connection element for removably connecting modular elements which are able to define a floor structure for intermediate stories, roofing, floating floors, ventilated roofs or upset roofs or a craw space used in self-supporting structures for insulating the floors from the underlying ground, wherein each one of said modular elements comprises an upper surface and supporting legs defining at least a lateral arch, said connection element being characterized in that it is shaped to define an arch element and a cradle element with lateral edges able to be connected to the corresponding lateral arches of the modular elements to be connected, to achieve a substantially continuous structure, said cradle element defining a seating for lodging at least one structural reinforcement element, such as a beam, a joist or a lattice able to fulfill a static bearing function, the seating comprising, on the bottom of the seating, supporting elements suitable to hold the relative reinforcement element in a raised position and to allow it to be incorporated substantially completely into a cast concrete.

17. A connection element for removably connecting modular elements which are able to define a floor structure for intermediate stories roofing, floating floors, ventilated roofs or upset roofs or a craw space used in self-supporting structures for insulating the floors from the underlying ground, wherein each one of said modular elements comprises an upper surface and supporting legs defining at least a lateral arch, said connection element being characterized in that it is shaped to define an arch element and a cradle element with lateral edges able to be connected to the corresponding lateral arches of the modular elements to be connected, to achieve a substantially continuous structure, said cradle element defining a seating for lodging at least one structural reinforcement element, such as a beam, a joist or a lattice able to fulfill a static bearing function, and further comprising a point equipped with a pre-breaking cut such as to allow the removal of a last section in the event of in-line coupling of two or more connection elements therebetween.

* * * * *